US005873954A

United States Patent [19]

Liebermann et al.

[11] Patent Number: 5,873,954

[45] **Date of Patent: *Feb. 23, 1999**

[54] AMORPHOUS ALLOY WITH INCREASED OPERATING INDUCTION

[75] Inventors: Howard H. Liebermann, Succasunna; Nicholas J. DeCristofaro, Chatham, both of N.J.

[73] Assignee: AlliedSignal Inc.

[ * ] Notice: The term of this patent shall not extend beyond the expiration date of Pat. No. 5,593,513.

[21] Appl. No.: 796,011

[22] Filed: Feb. 5, 1997

[51] Int. Cl.[6] ..... H01F 1/153

[52] U.S. Cl. ..... 148/304; 148/307; 420/117; 420/121

[58] Field of Search ..... 148/304, 403, 148/307; 420/117, 121

[56] References Cited

U.S. PATENT DOCUMENTS

| | | | |
|---|---|---|---|
| 4,298,409 | 11/1981 | DeCristofaro et al. | 148/108 |
| 5,035,755 | 7/1991 | Nathasingh et al. | 148/304 |
| 5,370,749 | 12/1994 | Ames et al. | 148/304 |
| 5,496,418 | 3/1996 | Ramanan et al. | 148/304 |
| 5,593,513 | 1/1997 | Ramanan et al. | 148/304 |
| 5,593,518 | 1/1997 | Ramanan | 148/304 |

*Primary Examiner*—John Sheehan
*Attorney, Agent, or Firm*—John A. Squires; Ernest D. Buff

[57] ABSTRACT

A ferromagnetic amorphous metallic alloy strip is annealed to minimize exciting power rather than core loss. The strip has an exciting power less than 0.5 VA/kg when measured at 60 Hz and an operating induction of 1.40 to 1.45 Tesla, the measurement being carried out at ambient temperature. Cores composed of the strip can be run at higher operating induction than those annealed to minimize core loss. The physical size of the transformer's magnetic components, including the core, is significantly reduced.

6 Claims, 8 Drawing Sheets

AMORPHOUS ALLOY WITH INCREASED OPERATING INDUCTION

BACKGROUND OF THE INVENTION

1. Field Of The Invention

This invention relates to amorphous metallic transformer cores having increased operating induction; and more particularly, to a magnetic field annealing process that markedly increases such operating induction.

2. Description Of The Prior Art

Soft magnetic properties of amorphous metallic transformer core alloys are developed as a result of annealing at suitable temperature and time in the presence of a magnetic field. One of the purposes for such annealing is to reduce the adverse effects of residual stresses which result from the rapid cooling rate associated with amorphous alloy manufacturing processes. Another purpose is to define the "magnetic easy axis" in the body being annealed; i.e. to define a preferred orientation of magnetization which would ensure low core loss and exciting power of the body being annealed. Historically, such magnetic field annealing has been performed to minimize the core loss of the annealed body, as disclosed U.S. Pat. Nos. 4,116,728 and 4,528,481 for example. In addition to magnetic field annealing, annealing of amorphous alloys while under tensile stress has also been shown to result in improved soft magnetic properties viz. U.S. Pat. Nos. 4,053,331 and 4,053,332. Sample configuration for tensile stress annealing has invariably been flat strip. The use of stress annealing in the production on amorphous alloy transformers is impracticable.

The two most important magnetic properties of a transformer core are the core loss and exciting power of the core material. When magnetic cores of annealed metallic glass are energized (i.e., magnetized by the application of a magnetic field) a certain amount of the input energy is consumed by the core and is lost irrevocably as heat. This energy consumption is caused primarily by the energy required to align all the magnetic domains in the amorphous metallic alloy in the direction of the field. This lost energy is referred to as core loss, and is represented quantitatively as the area circumscribed by the B-H loop generated during one complete magnetization cycle of the material. The core loss is ordinarily reported in units of W/kg, which actually represents the energy lost in one second by a kilogram of material under the reported conditions of frequency, core induction level and temperature.

Core loss is affected by the annealing history of the amorphous metallic alloy. Put simply, core loss depends upon whether the alloy is under-annealed, optimally annealed or over-annealed. Under-annealed alloys have residual, quenched-in stresses and related magnetic anisotropy's which require additional energy during magnetization of the product and result in increased core losses during magnetic cycling. Over-annealed alloys are believed to exhibit maximum atomic "packing" and/or can contain crystalline phases, the result of which is a loss of ductility and/or inferior magnetic properties such as increased core loss caused by increased resistance to movement of the magnetic domains. Optimally annealed alloys exhibit a fine balance between ductility and magnetic properties. Presently, transformer manufacturers utilize annealing conditions which minimize the core loss of the amorphous metallic alloy transformer core. Typically, core loss values of less than 0.37 W/kg (60 Hz and 1.4 T) are achieved.

Exciting power is the electrical energy required to produce a magnetic field of sufficient strength to achieve in the metallic glass a given level of induction (B) . Exciting power is proportional to the required magnetic field (H), and hence, to the electric current in the primary coil. An as-cast iron-rich amorphous metallic alloy exhibits a B-H loop which is somewhat sheared over. During annealing, as-cast anisotropies and cast-in stresses are relieved, the B-H loop becomes more square and narrower relative to the as-cast loop shape until it is optimally annealed. Upon over-annealing, the B-H loop tends to broaden as a result of reduced tolerance to strain and, depending upon the degree of over-annealing, existence of crystalline phases. Thus, as the annealing process for a given alloy progresses from under-annealed to over-annealed, the value of the exciting power for a given level of magnetization initially decreases, then reaches an optimum (lowest) value, and thereafter increases. However, the annealing conditions which produce an optimum (lowest) value of exciting power in an amorphous metallic alloy do not coincide with the conditions which result in lowest core loss. As a result, amorphous metallic alloys, annealed to minimize core loss do not exhibit optimal exciting power.

It should be apparent that optimum annealing conditions are different for amorphous alloys of different compositions, and for each property required. Consequently, an "optimum" anneal is generally recognized as that annealing process which produces the best balance between the combination of characteristics necessary for a given application. In the case of transformer core manufacture, the manufacturer determines a specific temperature and time for annealing which are "optimum" for the alloy employed and does not deviate from that temperature or time.

In practice, however, annealing ovens and oven control equipment are not precise enough to maintain exactly the optimum annealing conditions selected. In addition, because of the size of the cores (typically up to 200 kg each) and the configuration of ovens, cores may not heat uniformly, thus producing over-annealed and under-annealed core portions. Therefore, it is of utmost importance not only to provide an alloy which exhibits the best combination of properties under optimum conditions, but also to provide an alloy which exhibits that "best combination" over a range of annealing conditions. The range of annealing conditions under which a useful product can be produced is referred to as an "annealing (or anneal) window".

SUMMARY OF THE INVENTION

The present invention provides a method for obtaining maximum operating induction in soft magnetic amorphous alloys. Generally stated, the magnetic amorphous alloy is annealed to minimize exciting power, rather than core loss. The method of the present invention significantly reduces the likelihood of "thermal runaway" at higher operating induction. Utilization of such higher operating induction, in turn, markedly decreases transformer core size requirements.

Also provided by the invention is a ferromagnetic amorphous metallic alloy strip having an exciting power less than 0.5 VA/kg when measured at 60 Hz and an operating induction ranging from 1.40 to 1.45 Tesla. Further provided is a ferromagnetic amorphous metallic alloy strip having a power loss less then about 0.15 W/Kg.

Also provided by the invention is a ferromagnetic amorphous metallic alloy core having an exciting power less than 1 VA/kg when measured at 60 Hz and an operating induction ranging from 1.40 to 1.45 Tesla. Further provided is a ferromagnetic amorphous metallic alloy core having a power loss less then about 0.25 W/Kg.

BRIEF DESCRIPTION OF THE DRAWINGS

The invention will be more fully understood and further advantages will become apparent when reference is had to the following detailed description and the accompanying drawings, in which.

DETAILED DESCRIPTION OF THE INVENTION

Figure 1A:
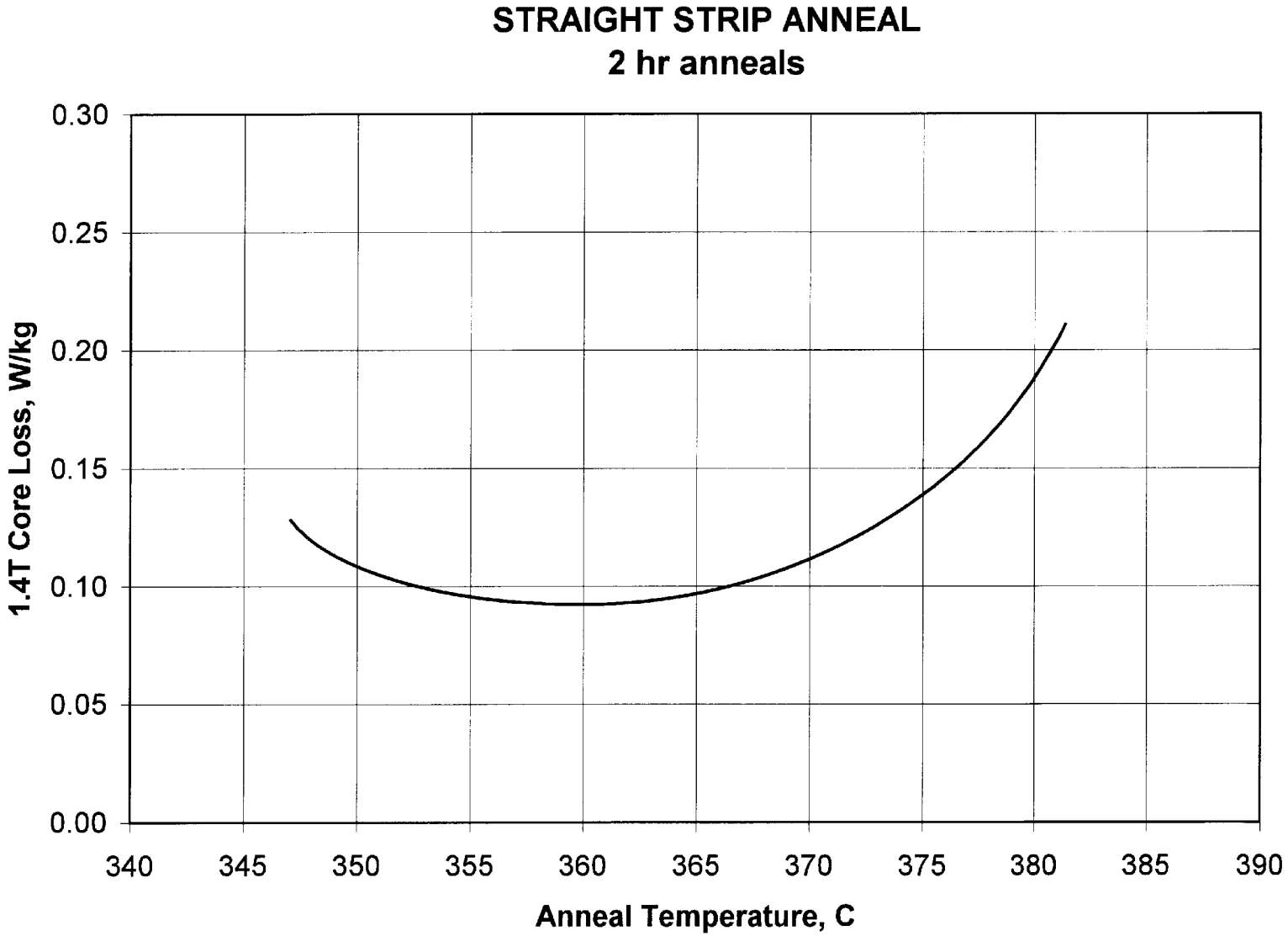
FIG. 1*a* is a graph depicting core loss as a function of temperature, the graph illustrating the core loss dependence of straight strip laboratory samples on 2 hour isochronal anneals conducted in a magnetic field at various temperatures.

As used herein, the term "amorphous metallic alloys" means a metallic alloy that substantially lacks any long range order and is characterized by X-ray diffraction intensity maxima which are qualitatively similar to those observed for liquids or inorganic oxide glasses.

As used herein, the term "strip" means a slender body, the transverse dimensions of which are much smaller than its length. Strip thus includes wire, ribbon, and sheet, all of regular or irregular cross-section.

The term "annealing", as used throughout the specification and claims, refers to the heating of a material, in the presence of a magnetic field for example, in order to impart thermal energy which, in turn, allows the development of useful properties . A variety of annealing techniques are available for developing these properties.

As used herein, the term "straight strip" refers to the configuration of a sample which is subjected to magnetic property measurements. The sample may be truly tested as a straight strip, in which case its length is much greater than that of the field/sensing coils. Alternatively, a more reasonable sample length can be used if the material under test is used as the fourth leg in a simple transformer core. In either case, the material under test is in the form of a straight strip.

The term magnetic "core", as used herein, refers to a magnetic element which is used in any number of electrical or electronic applications and devices. A magnetic core is usually constructed from magnetic strip or powder.

The term "peak temperature", as used herein, refers to the maximum temperature reached by any portion of the transformer core during the annealing cycle.

The term "soak time", as used herein, refers to the duration over which a core is actually at the annealing temperature, and does not include core heating and cooling times.

The terms "saturation induction" and "operating induction" refer to two magnetic induction levels relevant to transformer core materials and the operation thereof. Saturation induction is the maximum amount of induction available in a material. Operating induction is the amount of magnetic induction used in the operation of a transformer core. For amorphous metallic alloys, saturation induction is determined by alloy chemistry and by temperature. Saturation induction decreases as temperature is increased.

The operating induction of a magnetic material is determined by the saturation induction. Transformers are designed to operate at magnetic induction levels less than the saturation induction. The primary reason for this design requirement involves the permeability ($\mu$) of the magnetic core material. Permeability is defined as the ratio of the magnetic induction (B) to the magnetic field (H) required to drive the material to that induction; i.e. $\mu$=B/H. Permeability decreases as the magnetic induction is increased to levels approaching the saturation induction. If a transformer core is operated at a magnetic induction too close to the saturation induction of the core material, a disproportionally large magnetic field will be required to achieve the additional magnetic induction. In transformers, magnetic field is applied by passing electric current through the primary coil. Thus, a large increase in the required magnetic field necessitates a large increase in the current through the primary coil.

A large increase in the primary current of a transformer is undesirable for a number of reasons. Large current variations through a single transformer can degrade the quality of electric power through the neighboring electric power grid. An increase in the primary current will also result in increased Joule ($I^2R$) heating within the primary coil. This electrical energy lost by conversion to heat detracts from the efficiency of the transformer. In addition, excessive current will cause excessive heating of the primary coil, which can lead to the physical deterioration and failure of the electrical insulation used within the coil. Failure of the electrical insulation will lead directly to failure of the transformer. The heat generated in the primary coil can also heat the magnetic core of the transformer.

The latter effect described above, heating of the magnetic core of the transformer, can lead to a condition called "thermal runaway". As the temperature of the magnetic core is increased, the saturation induction of the magnetic material decreases. For a transformer performing at a fixed operating induction, the thermally induced decrease in saturation induction creates the same effect as an additional increase in the operating induction. Additional electric current is drawn through the primary coil, creating additional Joule heating. The temperature of the magnetic core of the transformer is further increased, exacerbating the situation. This uncontrolled increase in transformer temperature associated with "thermal runaway" is another common reason for failure of transformer cores in the field.

To avoid these undesirable conditions, transformers are typically designed such that the operating induction of the core under standard conditions is no more than about 80 to 90% of the saturation induction of the core material.

The present invention provides a method for annealing amorphous alloys that permits decreased exciting power and increased operating induction without inducing thermal runaway. It is desirable to operate a transformer core at as high an induction level as possible so that the cross-section of the core can be minimized. That is, a transformer core works on the basis of the number of lines of magnetic flux, not on the flux density (induction). The ability to increase operating flux density permits use of smaller transformer core cross-sections, while utilizing a given flux. Substantial benefits are thereby derived from manufacture of core sizes that are smaller for transformers of given ratings.

As described hereinabove, the optimum annealing temperature and time for metallic glass presently used in transformer manufacture is a temperature in the range of 140°–100° C. below the crystallization temperature of the alloy, for a time period ranging from 1.5–2.5 hours for minimized core loss.

Figure 1B:
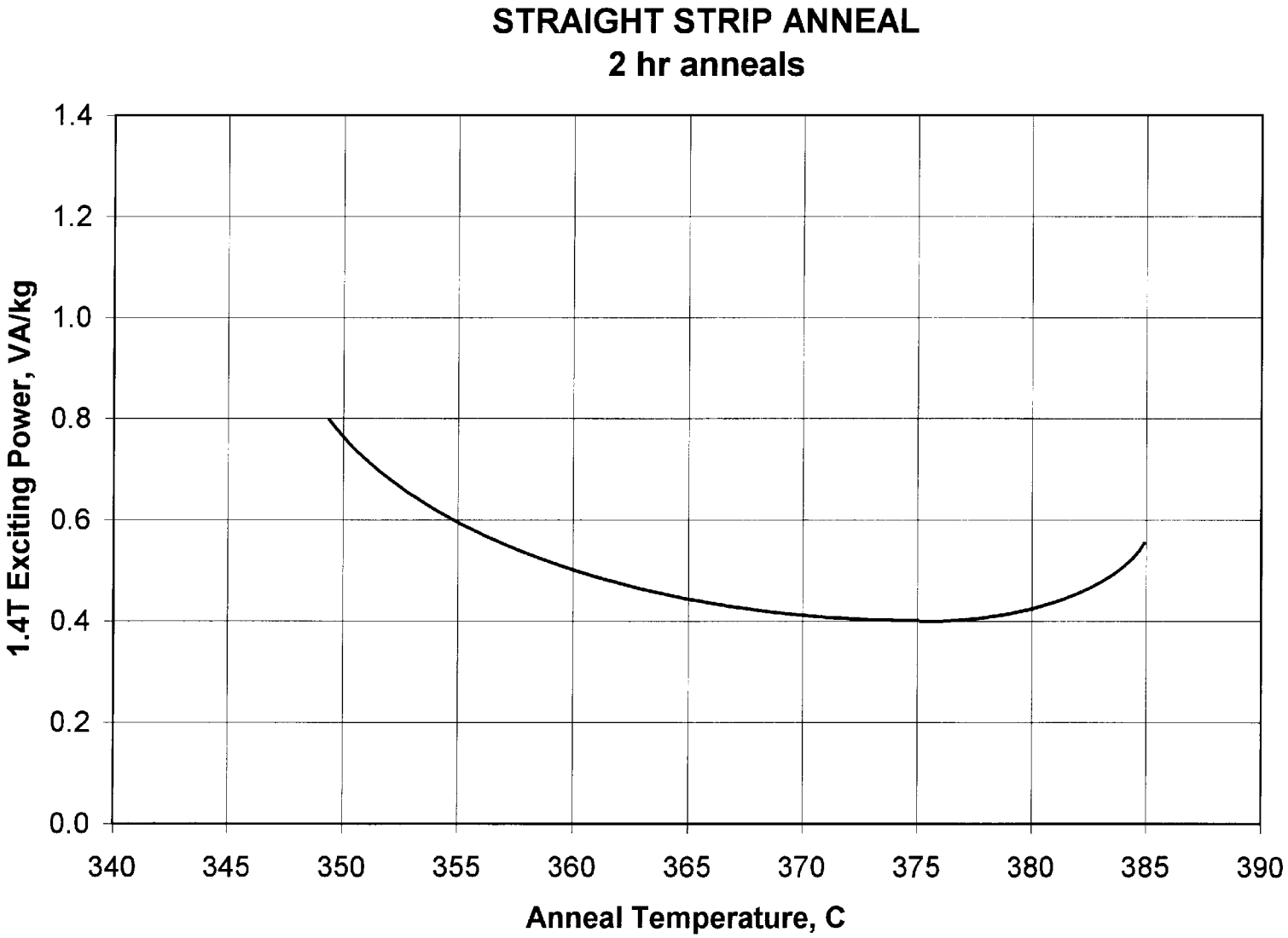
FIG. 1*b* is a graph depicting exciting power as a function of temperature, the graph illustrating the exciting power dependence of straight strip laboratory samples on 2 hour isochronal anneals conducted in a magnetic field at various temperatures.

The dependence of magnetic core loss on annealing temperature for straight strip samples of METLAS® alloy 2605SA-1, after having been annealed for 2 hours, is shown in FIG. 1*a*. At lower temperatures, core loss is high because of insufficient annealing, which results in the magnetic easy axis not being well-defined. In contrast, core loss is high at higher temperatures because of the onset of crystallization in the amorphous alloy. The lowest core loss is seen to result at about 360° C. for the straight strip samples. FIG. 1*b* shows the dependence of exciting power on annealing temperature for straight strip samples of METLAS® alloy 2605SA-1, after having been annealed for 2 hours. In this case, the optimum (minimum) exciting power is seen to result when annealing for 2 hours at about 375° C. This difference in optimization temperatures is very significant because both technical and patent literature have taught the annealing of amorphous alloys to optimize core loss only, whereas the reason for transformer core failure is high exciting power.

Figure 2A:
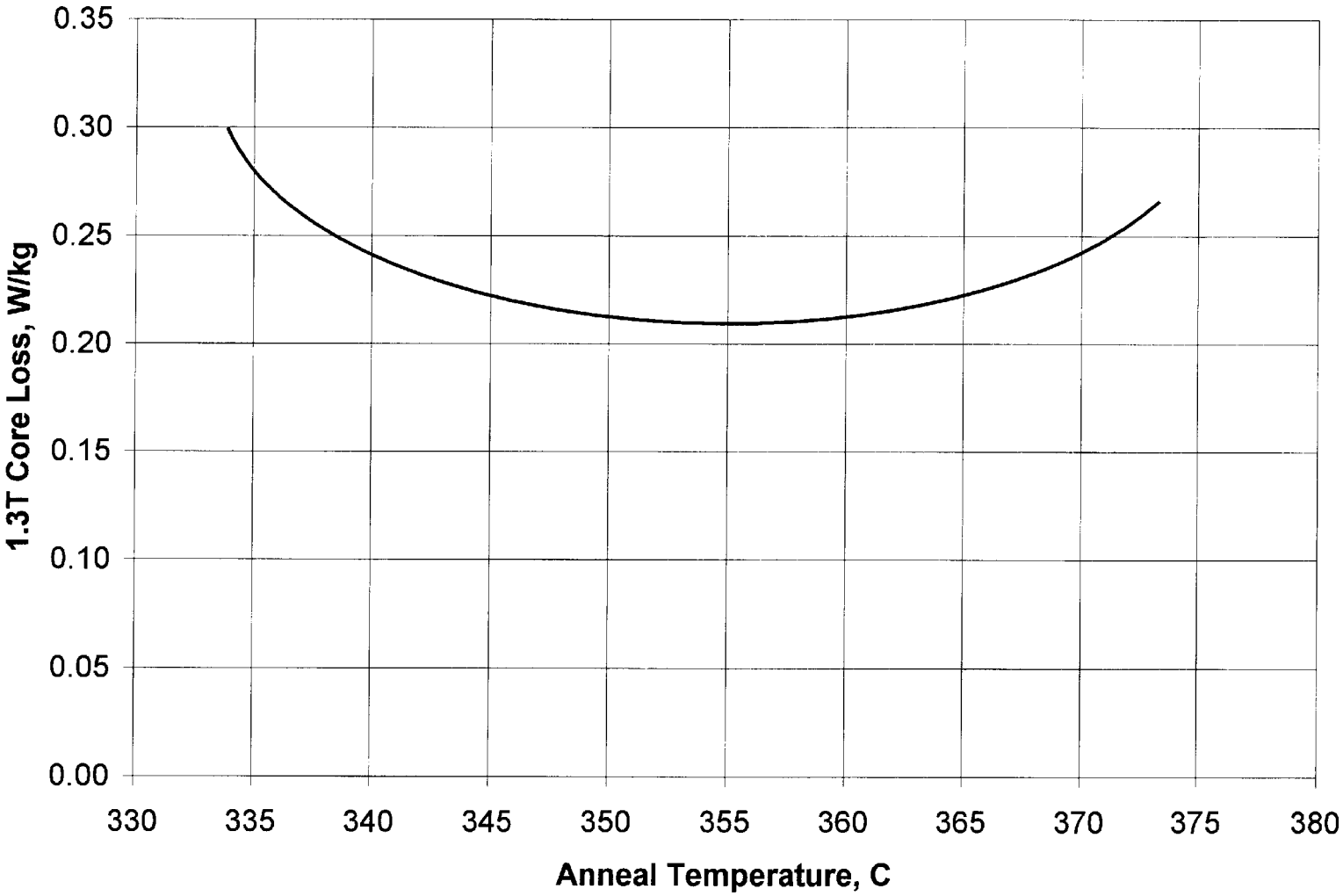
FIG. 2*a* is a graph depicting core loss as a function of temperature, the graph illustrating the core loss dependence of actual transformer cores on 2 hour isochronal anneals conducted in a magnetic field at various temperatures.
Figure 2B:
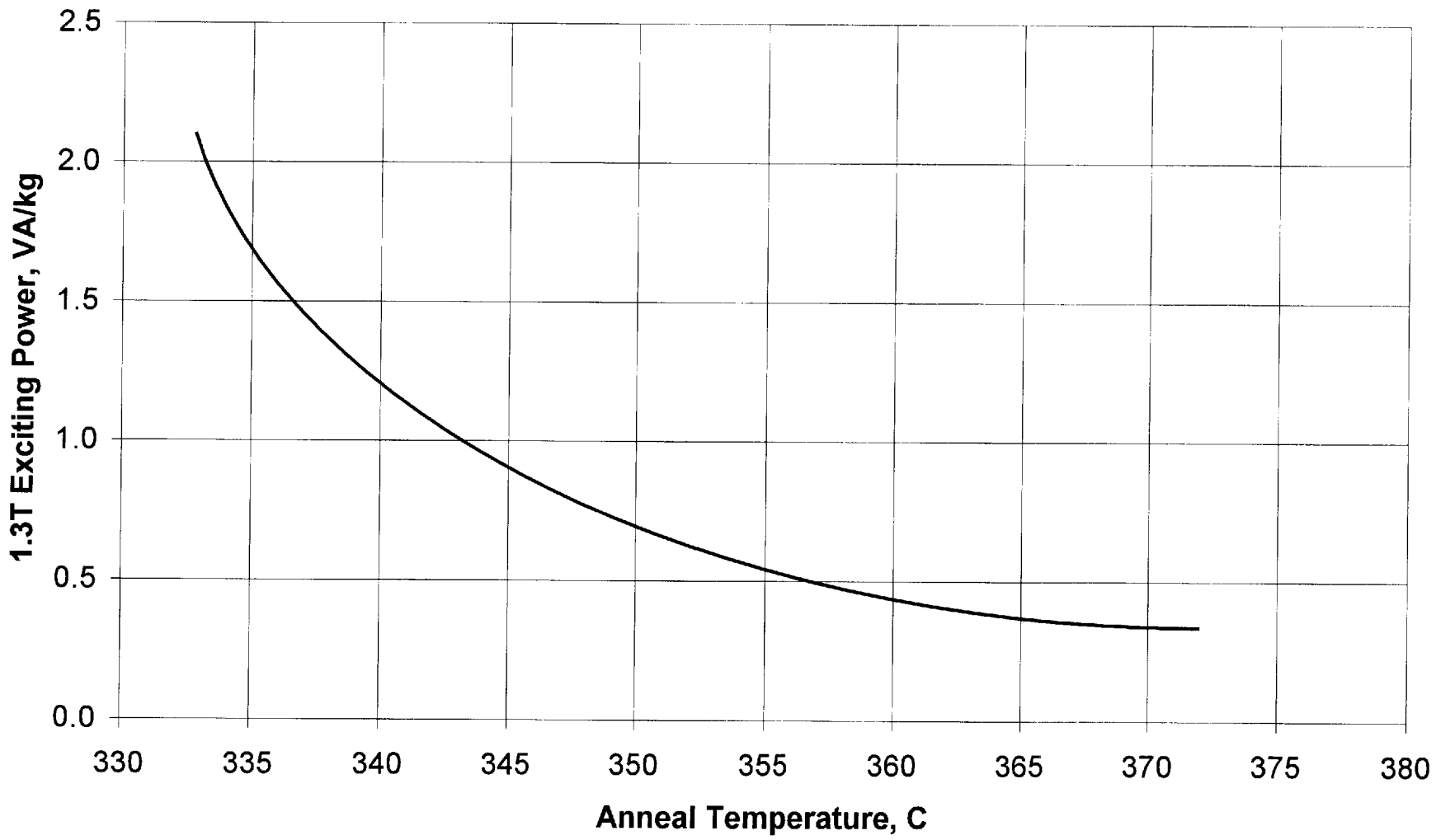
FIG. 2*b* is a graph depicting exciting power as a function of temperature, the graph illustrating the exciting power dependence of actual transformer cores on 2 hour isochronal anneals conducted in a magnetic field at various temperatures.

The data in FIGS. 2*a* and 2*b* are similar to those of FIGS. 1*a* and 1*b*, except that they now pertain to full-sized industrial transformer cores. It is significant that the benefit of annealing straight strip samples at higher temperatures are also realized for the actual transformer cores. This demonstrates the commercial utility of the present invention.

Figure 3:
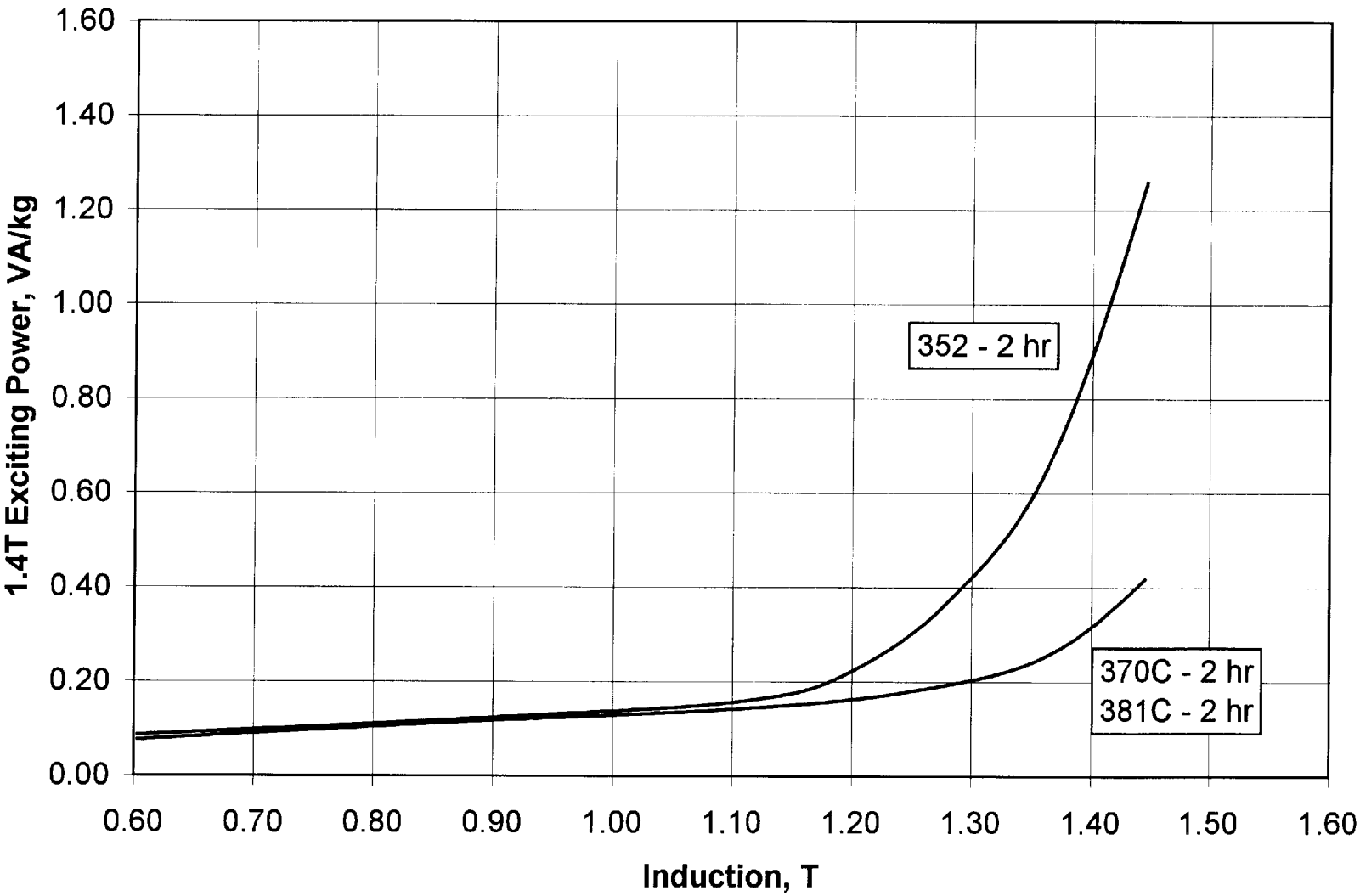
FIG. 3 is a graph depicting exciting power as a function of induction, the graph illustrating the induction level dependence of exciting power for straight strip samples annealed at there different conditions.

Another way in which the results of the present invention can be illustrated is given in FIG. 3. The curves in FIG. 3 show the induction level dependence of exciting power for straight strip samples which were annealed according to the times and temperatures indicated. The benefits of a higher temperature anneal are clear. For example, if a given exciting power level is chosen, a higher operating induction can be used for samples which have been annealed at higher temperature. The data in FIG. 3 indicates that as much as a 5% increase in operating induction could be realized.

Figure 4:
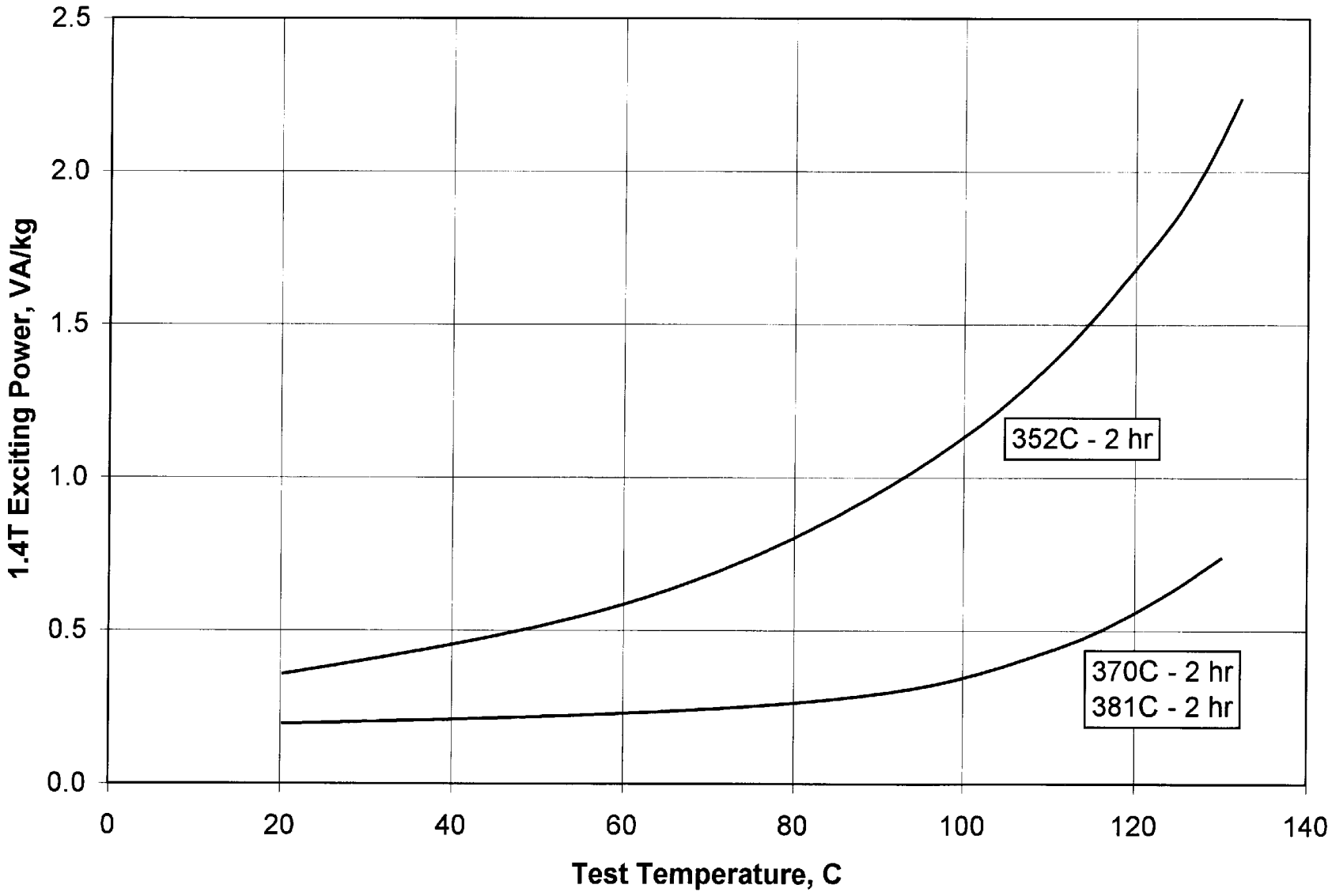
FIG. 4 is a graph depicting exciting power as a function of test temperature, the graph illustrating exciting power dependence on test temperature for straight strip samples which have been annealed using three different conditions.

A further advantage of the present invention is illustrated in FIG. 4, in which the dependence of straight strip sample exciting power on sample test temperature is shown. It is readily apparent from FIG. 4 that the benefits derived from the invention are greater at higher sample temperature. This is important because transformers operate at temperatures greater than ambient and can achieve even higher temperatures when going into an overload condition. Thus, the teachings of the invention have a particularly useful benefit.

Figure 5:
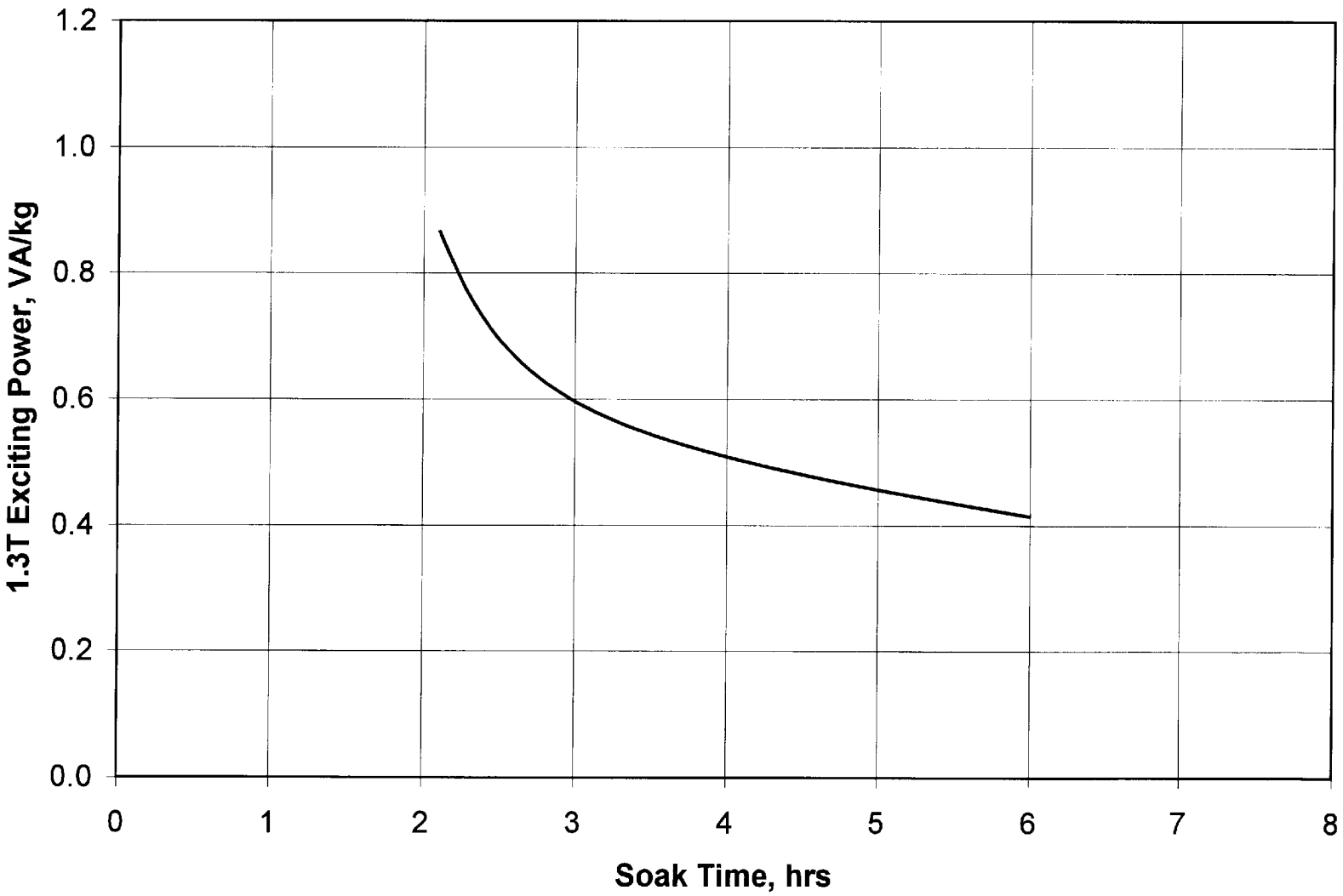
FIG. 5 is a graph depicting exciting power as a function of soak time, the graph illustrating the transformer core soak time dependence of exciting power
Figure 6:
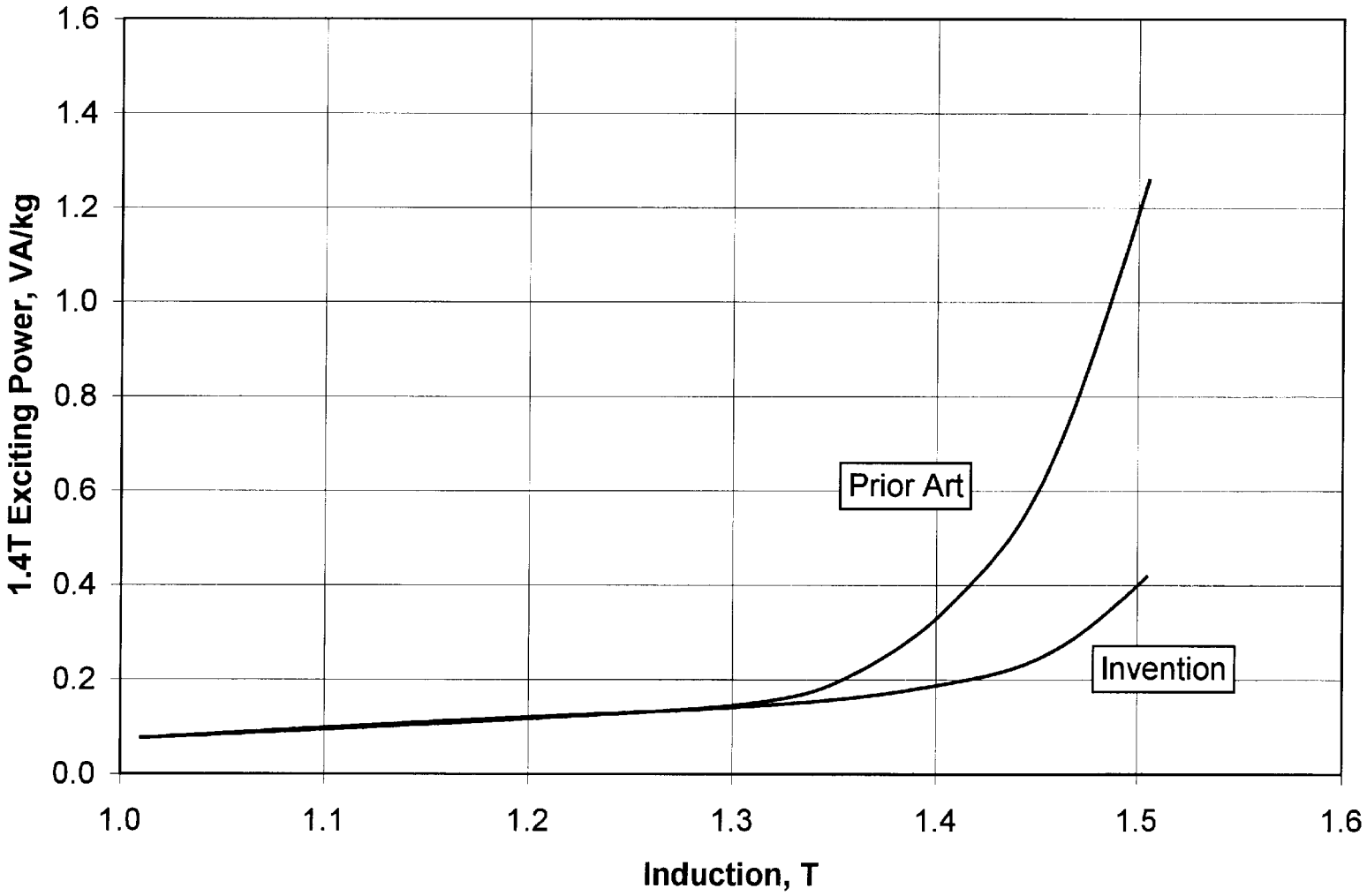
FIG. 6 is a graph depicting exciting power as a function of induction, the graph illustrating the induction level dependence of exciting power for actual transformer cores which have been annealed in a magnetic field using different soak times.

Annealing is a time/temperature process. As such, FIG. 5 shows the dependence of transformer core exciting power on "soak time" during annealing. It is significant that, again, exciting power decreases with increased soak time. This illustrates the option of using either annealing cycle soak time or temperature to develop the method of the present invention on a commercial scale. As FIG. 3, FIG. 6 shows the dependence of transformer core exciting power on induction for cores which have been annealed using different soak times.

EXAMPLE 1

Sixteen single phase wound cores for use in commercial distribution transformers were made using 6.7" wide METGLAS® alloys SA-1, having a nominal chemistry $Fe_{80}B_{11}Si_9$. Each core weighed about 75 kg. These sixteen cores were broken into groups of four, each group being annealed at about 355° C. with a different soak time. The baseline anneal soak time, to achieve minimum power loss, is about 20 minutes. The three other groups were annealed using soak times of 30, 40, and 60 minutes, which soak times represented an increase of 50%, 100% and 150%, respectively. Results of for all of these cores have already been shown in FIGS. 5 and 6. A significant decrease in core exciting power was evident for each of the increased soak times. Further, it was found that longer soak times resulted in lower exciting power.

EXAMPLE 2

Three single phase wound cores for use in commercial distribution transformers were made using 6.7" wide METGLAS® alloy SA-1, having a nominal chemistry $Fe_{80}B_{11}Si_9$. Each core weighed about 118 kg, and care was taken to minimize thermal gradient effects in the cores during heat-up and cool-down. These three cores were annealed using a soak time of 20 minutes and a peak temperature of about 370° C. rather than the normally used peak temperature of about 355° C. The results of exciting power and core loss measurements on these cores, which were annealed at higher temperature, are shown in comparison to those of cores which have been annealed conventionally in FIG. 2*a* and 2*b*, respectively. It is clear that a substantial decrease in exciting power is realized when the peak temperature used during anneal of the core is increased, while only incurring a small increase in core loss. The results of Example 2, produced by annealing at increased peak temperature, are comparable to those produced in Example 1 by annealing for extended soak times.

EXAMPLE 3

Straight strip laboratory samples were made using 6.7" wide METGLAS® alloy SA-1, having a nominal chemistry $Fe_{80}B_{11}Si_9$. These straight strip samples were subjected to two hour isochronal anneals conducted in a magnetic field at various temperatures. The results of exciting power and core loss measurements on these straight strip laboratory samples are depicted as a function of temperature in FIG. 1*a* and 1*b*. It is clear that a substantial decrease in exciting power is realized when the peak temperature of the anneal is increased by at least 5° C.

EXAMPLE 4

Straight strip laboratory samples were made using 6.7" wide METGLAS® alloy SA-1, having a nominal chemistry $Fe_{80}B_{11}Si_9$. These straight strip samples were subjected to two hour isochronal anneals conducted in a magnetic field at various temperatures. FIG. 4 shows the exciting power measured at the temperature indicated, after having been annealed. The results indicate an even greater exciting power reduction at elevated temperatures, at which transformer cores operate, than at room temperature.

Having thus described the invention in rather full detail, it will be understood that such detail need not be strictly adhered to, but that various changes and modifications may suggest themselves to one skilled in the art, all falling within the scope of the invention, as defined by the subjoined claims.

What is claimed is:

1. A ferromagnetic amorphous metallic alloy strip having a composition consisting of about 11 atom percent boron and 9 atom percent silicon, the balance being iron and incidental purities, said strip having an exciting power less than 0.5 VA/kg and a power loss less than about 0.15 W/kg when measured at 60 Hz and an operating induction of 1.40 to 1.45 Tesla, said measurement being carried out at ambient temperature.

2. A ferromagnetic amorphous metallic alloy strip having a composition consisting of about 11 atom percent boron and 9 atom percent silicon, the balance being iron and incidental purities, said strip having an exciting power less than 0.5 VA/kg and a power loss less than about 0.15 W/kg when measured at 60 Hz and an operating induction of 1.40 to 1.45 Tesla, said measurement being carried out at temperature of 100° C.

3. A strip as recited by claim 1 or 2, said strip having been annealed using a soak time at least 50% longer than that required to minimize said power loss.

4. A strip as recited by claim 1 or 2, said strip having been annealed using a soak time at least 150% longer than that required to minimize said power loss.

5. A strip as recited by claim 1 or 2, said strip having been annealed using a peak temperature of at least 5° C. higher than that required to minimize said power loss.

6. A strip as recited by claim 1 or 2, said strip having been annealed using a peak temperature of at least 15° C. higher than that required to minimize said power loss.

* * * * *